US006398501B1

(12) United States Patent
Darkins, Jr. et al.

(10) Patent No.: US 6,398,501 B1
(45) Date of Patent: Jun. 4, 2002

(54) APPARATUS FOR REDUCING THERMAL STRESS IN TURBINE AIRFOILS

(75) Inventors: Toby G. Darkins, Jr., Loveland; Mark E. Noe, Morrow; Douglas M. Carper, Blue Ash, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/399,194

(22) Filed: Sep. 17, 1999

(51) Int. Cl.[7] ..... F01D 5/14
(52) U.S. Cl. ..... 416/226; 416/232; 416/241 B
(58) Field of Search ..... 415/115, 191, 415/177, 178; 416/226, 232, 233, 233 A, 242, 223 R, 241 B, 96 R, 97 R, 96 A

(56) References Cited

U.S. PATENT DOCUMENTS 3,695,778 A * 10/1972 Taylor ..... 416/92
4,236,870 A * 12/1980 Hucul, Jr. et al. ..... 416/97 R
4,302,153 A * 11/1981 Tubbs ..... 416/96 R
4,416,585 A 11/1983 Abdel-Messeh
5,292,230 A * 3/1994 Brown ..... 416/223 A
5,507,621 A 4/1996 Cooper
5,741,117 A 4/1998 Clevenger et al.
5,951,256 A 9/1999 Dietrich
6,132,169 A 10/2000 Manning et al.
6,186,741 B1 2/2001 Webb et al.

* cited by examiner

*Primary Examiner*—Edward K. Look
*Assistant Examiner*—James M. McAleenan
(74) *Attorney, Agent, or Firm*—Andrew C. Hess; Rodney M. Young

(57) ABSTRACT

A turbine airfoil includes at least one spar arrangement having a length less than an associated turbine airfoil length. During operation, the turbine airfoil has an outer skin surface which operates at a substantially higher temperature than that of an internal supporting parted spar arrangement. The parted spar arrangement permits the turbine airfoil outer skin surface to thermally expand between spar arrangements, thus preventing self-constraining thermal stresses from forming within the spar arrangement or the airfoil skin surfaces.

19 Claims, 5 Drawing Sheets

APPARATUS FOR REDUCING THERMAL STRESS IN TURBINE AIRFOILS

GOVERNMENT RIGHTS

The government has rights in this invention pursuant to Contract No. F33615-97C-2778 awarded by the Department of the Air Force.

BACKGROUND OF THE INVENTION

This invention relates generally to airfoils and, more particularly, to turbine airfoils with parted spars.

Turbine airfoils include a blade tip, a blade length, and a blade root. Typically, a cooling system supplies pressurized air internally to the airfoil blade. The internal pressures created by the cooling system generate ballooning stresses at an outer skin of the airfoil blade. To prevent the internal pressures from damaging the airfoil blade, typically the outer skin is supported with a rigid spar which extends along the length of the airfoil.

External surfaces of turbine airfoils are subjected to high temperature gas flows during operation. Cooling a turbine airfoil prolongs the turbine airfoil useful life and improves turbine airfoil performance. Increasing the turbine airfoil performance enhances efficiency and performance of an associated turbine engine. As engine performance is enhanced, turbine airfoils are subjected to increased aerodynamic loading and higher temperature gas flows. To withstand such loads and temperatures, turbine airfoils may be fabricated using composite materials. Although such composite materials can withstand the loads and high temperatures, such materials usually are not as resistive to high temperature gradients as other known materials.

During operation, turbine airfoils are cooled internally with a pressurized cooling system. Accordingly, continuous spars operate at temperatures which are substantially less than the operating temperatures of the turbine airfoil outer skin surfaces. A temperature gradient between the continuous spar and the outer skin surfaces creates opposing thermal strains in both the continuous spar and the outer skin surfaces. The thermal strain mismatch created by the temperature gradient causes the continuous spar operating at a lower temperature to be in tension, and the outer skin surfaces to be in compression. Composite materials, such as ceramics, maintain a high modulus of elasticity and a low ductility at high temperatures, and the thermal stresses may cause cracks to develop within the continuous spars leading to failure of the turbine airfoil.

BRIEF SUMMARY OF THE INVENTION

In an exemplary embodiment, a turbine airfoil includes a parted spar arrangement which reduces thermal stresses within the turbine airfoil. The turbine airfoil includes a blade tip, a blade root, and a blade span extending between the blade tip and the blade root. The blade span includes a skin covering extending over the blade span, and at least one spar arrangement having a length less than a length of the blade span and positioned between the blade root and the blade tip. The spar arrangement includes a plurality of spars including at least a first spar having a first side and a second side.

During operation, the turbine airfoil is cooled internally such that an outer skin covering surface operates at higher temperatures than that of the parted spar arrangement and temperature gradients develop between the parted spars and the outer skin covering surface. Because the airfoil uses parted spar arrangements, the turbine airfoil skin surfaces are permitted to thermally expand between parted spar arrangements which prevents thermal stresses from developing as a result of the outer skin surfaces operating at higher temperatures. Accordingly, the outer skin coverings and the parted spar arrangements are not subjected to the potentially damaging thermal strains of known turbine airfoils and may be fabricated from low strength and low ductility materials to provide a turbine airfoil which includes a spar arrangement that is reliable and cost-effective.

DETAILED DESCRIPTION OF THE INVENTION

Figure 1:
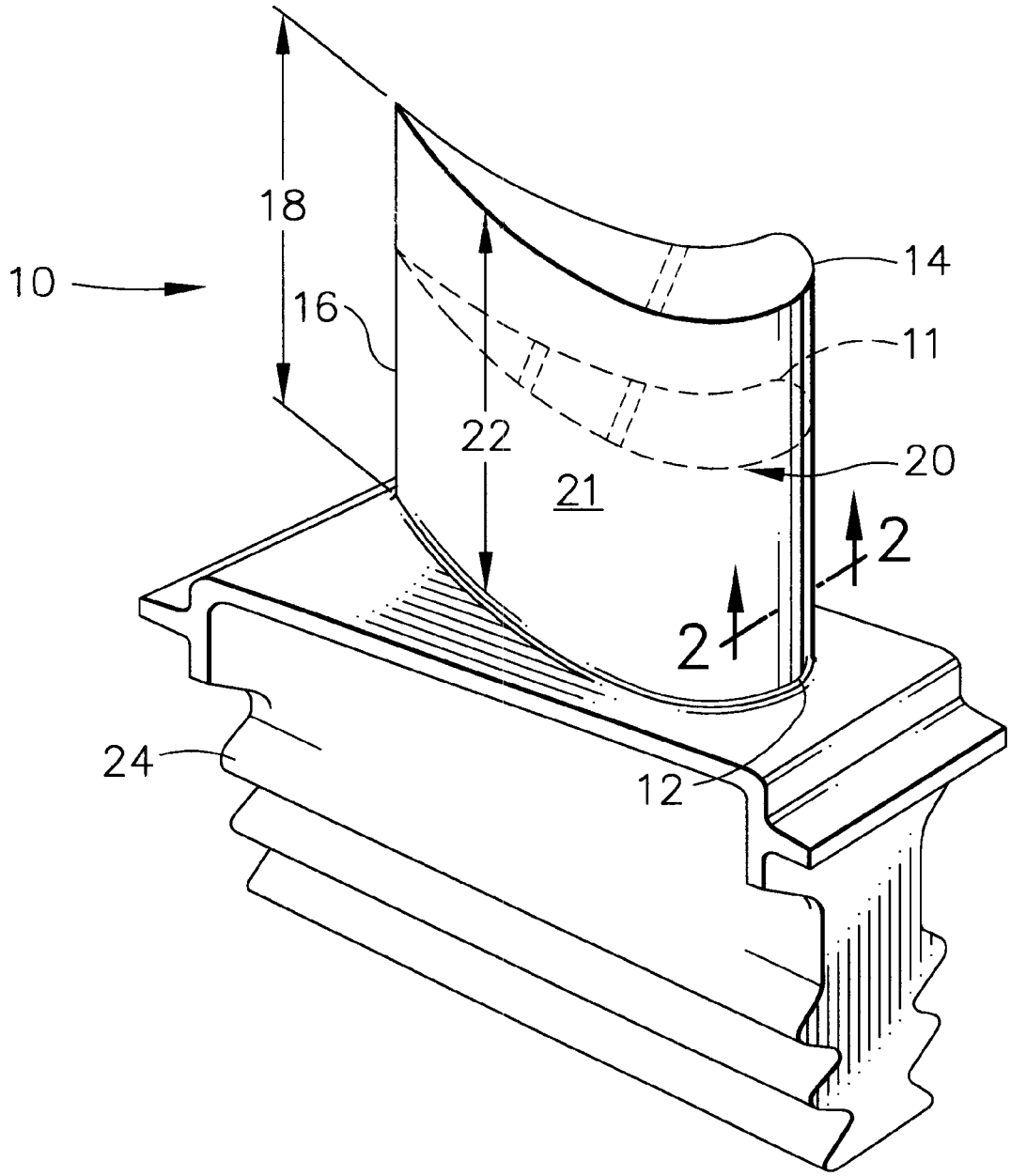
FIG. 1 is a perspective view of a turbine airfoil including a parted spar arrangement.

FIG. 1 is a perspective view of a turbine airfoil 10 including a parted spar arrangement 11. Turbine airfoil 10 includes a blade root 12, a blade tip 14, and a blade span 16 extending between blade root 12 and blade tip 14. Blade span 16 has a length 18 and includes a skin covering 20 which extends over blade span 16 from blade root 12 to blade tip 14. Skin covering 20 includes an outer skin surface 21 and an inner skin surface (not shown in FIG. 1). Blade length 18 extends between blade root 12 and blade tip 14 along a line 22. In one embodiment length 18 is approximately 2.0 inches. Turbine airfoil 10 extends from a mounting feature 24 which is configured to anchor turbine airfoil 10 to an associated turbine engine (not shown). In one embodiment, mounting feature 24 is a dovetail key.

Figure 2:
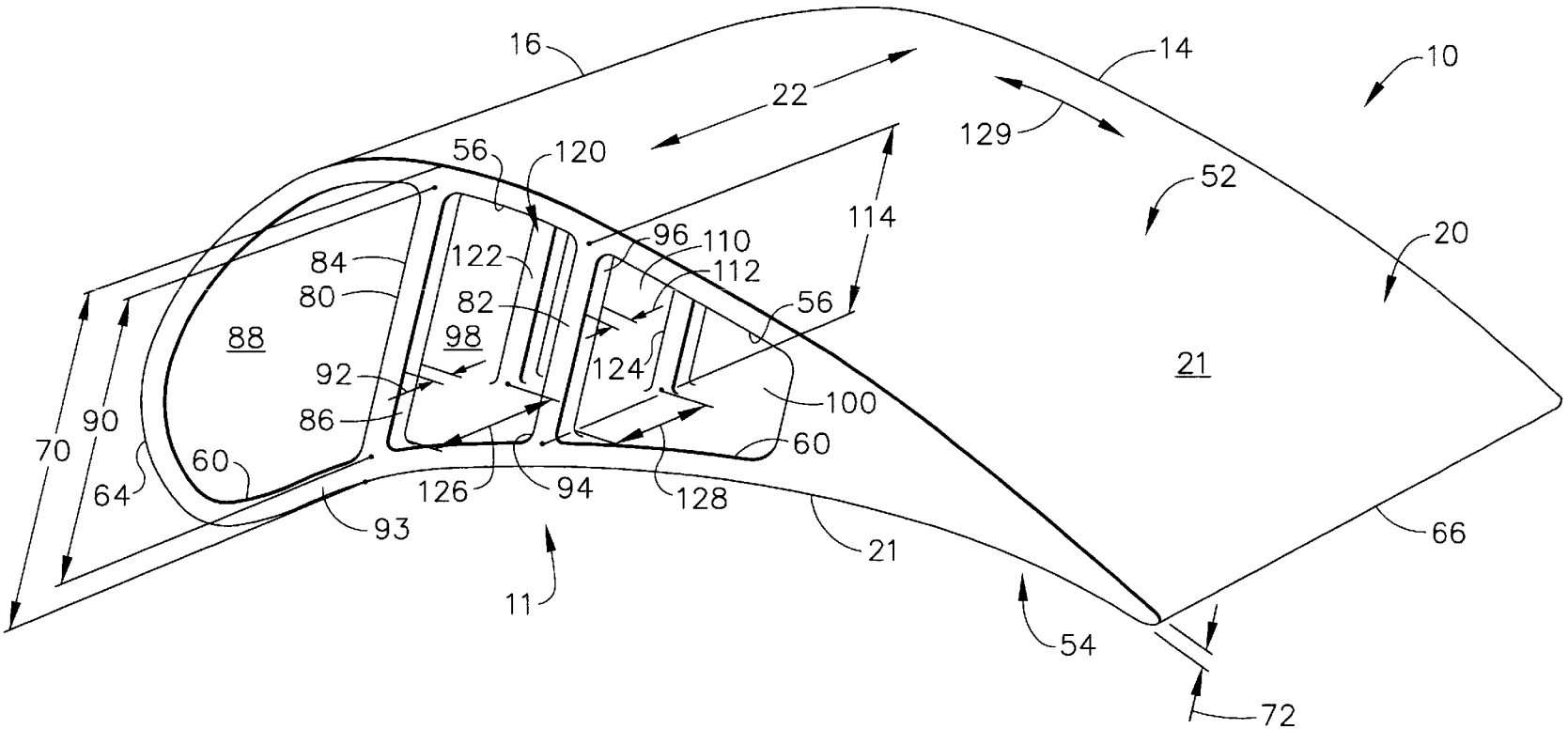
FIG. 2 is a cross-sectional view of the turbine airfoil along line 2—2 shown in FIG. 1.

FIG. 2 is a partial perspective view of turbine airfoil 10 including a parted spar arrangement 11. Turbine airfoil 10 includes a suction side 52 and a pressure side 54. Pressure side 54 has more curvature than suction side 52. When turbine airfoil 10 is exposed to an airflow, the increased curvature of pressure side 54 causes an area of low pressure to form adjacent suction side 52 of turbine airfoil 10 and an area of high pressure to form adjacent pressure side 54 of turbine airfoil 10.

Turbine airfoil 10 is manufactured such that spar arrangement 11 is integrally connected with skin covering 20 and extends from skin covering 20. Accordingly, suction side 52 of turbine airfoil 10 includes outer skin surface 21 and an inner skin surface 56, and pressure side 54 of turbine airfoil 10 includes outer skin surface 21, and an inner skin surface 60. Pressure side 54 and suction side 52 are connected to spar arrangement 11 and define a turbine airfoil leading edge 64 and a trailing edge 66. Leading edge 64 is smooth and extends between suction side 52 and pressure side 54. Leading edge 64 has a width 70 which is greater than a width 72 of trailing edge 66.

Parted spar arrangement 11 includes a first spar 80 and a second spar 82 positioned between first spar 80 and trailing edge 66. First spar 80 has a first side 84 and a second side 86. A first cavity 88 is formed between leading edge 64 and first spar first side 84. First spar 80 extends from suction side inner skin surface 56 to pressure side inner skin surface 60 for a width 90. First spar 80 also has a length 92 which extends from a first side 93 of spar arrangement 11 in a direction substantially parallel to line 22 to a second side (not shown) of spar arrangement 11. In one embodiment, width 90 is approximately 0.5 inches and length 92 is approximately 0.25 inches.

Second spar 82 has a first side 94 and a second side 96. A second cavity 98 is formed between first spar second side 86, second spar first side 94, pressure side inner skin surface 60 and suction side inner skin surface 56. Suction side inner skin surface 56 and pressure side inner skin surface 60 are connected and form a trailing edge wall 100. Suction side outer skin surface 21 and pressure side outer skin surface 21 extend from trailing edge wall 100 to form trailing edge 66. A third cavity 110 is formed between suction side inner skin surface 56, pressure side inner skin surface 60, trailing edge wall 100, and second spar second side 96. Second cavity 98 is positioned between first cavity 88 and third cavity 110.

Second spar 82 has a length 112 which extends from first side 93 of spar arrangement 11 to the second side of spar arrangement 11. Second spar 82 also has a width 114 which extends from suction side inner skin surface 56 to pressure side inner skin surface 60. In one embodiment, length 112 is substantially equal to length 92 of first spar 80. Alternatively, length 112 of second spar 82 is different than length 92 of first spar 80. In another embodiment, first spar 80 is offset from second spar 82 in direction 22. In a further embodiment, length 112 is approximately 0.3 inches, width 114 is approximately 0.3 inches, and first spar 80 is offset approximately 0.1 inches in direction 22 from second spar 82.

During operation, outer skin surface 21 is subjected to high temperature gas flows. To cool turbine airfoil 10, a cooling system (not shown) supplies a pressurized airflow internally to turbine airfoil 10. Because of the pressurized airflow supplied by the cooling system, spar arrangement 11 operates at a substantially cooler temperature than skin covering 20 including outer skin surface 21, pressure side inner skin surface 60, and suction side inner skin surface 56. Accordingly, a temperature gradient is created between skin covering 20 and spar arrangement 11.

Spar arrangement spars 80 and 82 have lengths 92 and 112 respectively, which permit pressure side 54 and suction side 52 to thermally expand without developing thermal strains in spar arrangement 11. As a result, spar arrangement 11 can be constructed from low strength and low ductility material. In one embodiment, spar arrangement 11 is constructed from SiC—SiC Ceramic Matrix Composite material. Alternatively, spar arrangement 11 is constructed from a monolithic ceramic material.

Alternatively, turbine airfoil 10 may be fabricated with additional spar arrangements 120. Spar arrangements 120 are constructed substantially similarly to spar arrangement 11 and include a first spar 122 and a second spar 124. Spar arrangements 120 are positioned between spar arrangement 11 and blade tip 14 and spars 122 and 124 are located a distance 126 and 128 respectively from spar arrangement 11. In one embodiment, spar arrangements 120 are located approximately 0.1 inches from spar arrangement 11. In another embodiment, first spar 122 is offset from first spar 80 in a direction 129 and second spar 124 is offset from second spar 82 in direction 129. In one embodiment, spars 122 and 124 are offset from spars 80 and 82 respectively, approximately 0.1 inches in direction 129.

Figure 3:
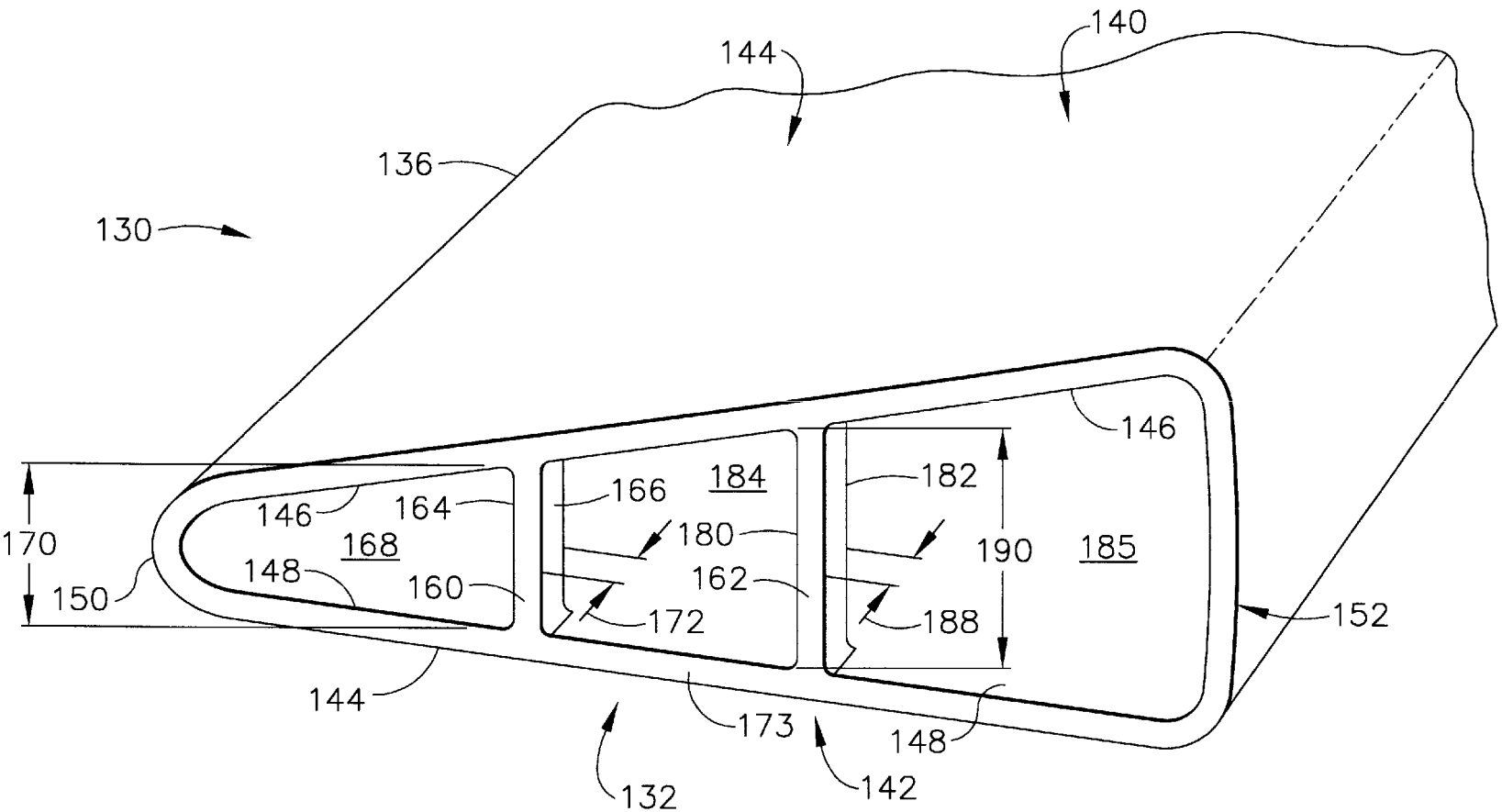
FIG. 3 is a cross-sectional view of an alternative embodiment of a turbine airfoil including a parted spar arrangement.

FIG. 3 is a partial perspective view of a turbine airfoil 130 including a parted spar arrangement 132. In one embodiment, turbine airfoil 130 is a frame strut. Turbine airfoil 130 includes a blade tip (not shown), a blade root (not shown), and has a blade span 136 which extends between the blade root and the blade tip. Turbine airfoil 130 further includes a first side 140 and a second side 142. Turbine airfoil 130 includes an outer skin covering surface 144 which extends over blade span 136. First side 140 includes outer skin covering surface 144 and an inner skin surface 146. Second side 142 of turbine airfoil 130 includes outer skin surface 144 and an inner skin surface 148. First side 140 and second side 142 are connected to spar arrangement 132 and define a turbine airfoil leading edge 150. Leading edge 150 is smooth and extends between first side 140 and second side 142. Outer skin surface 144 extends from leading edge 150 to a trailing edge 152. Turbine airfoil first side 140 has a curvature extending from leading edge 150 to trailing edge 152 that is substantially the same as a curvature extending over second side 142. In one embodiment turbine airfoil 130 is a symmetrical airfoil.

Parted spar arrangement 132 includes a first spar 160 and a second spar 162 positioned between first spar 160 and trailing edge 152. First spar 160 has a first side 164 and a second side 166. A first cavity 168 is formed between leading edge 150 and first spar first side 164. First spar 160 extends from first side inner skin surface 146 to second side inner skin surface 148 for a width 170. First spar 160 also has a length 172 extending from a first side 173 of spar arrangement 132 to a second side (not shown) of spar arrangement 132.

Second spar 162 has a first side 180 and a second side 182. A second cavity 184 is formed between first spar second side 166, second spar first side 180, first side inner skin surface 146 and second side inner skin surface 148. A third cavity 185 is formed between second spar second side 182, first side inner skin surface 146, trailing edge 152, and second side inner skin surface 148. Second spar 162 has a length 188 which extends from first side 173 of spar arrangement 132 to the second side of spar arrangement 132. Second spar 162 also has a width 190 which extends from second side inner skin surface 148 to first side inner skin surface 146.

Figure 4:
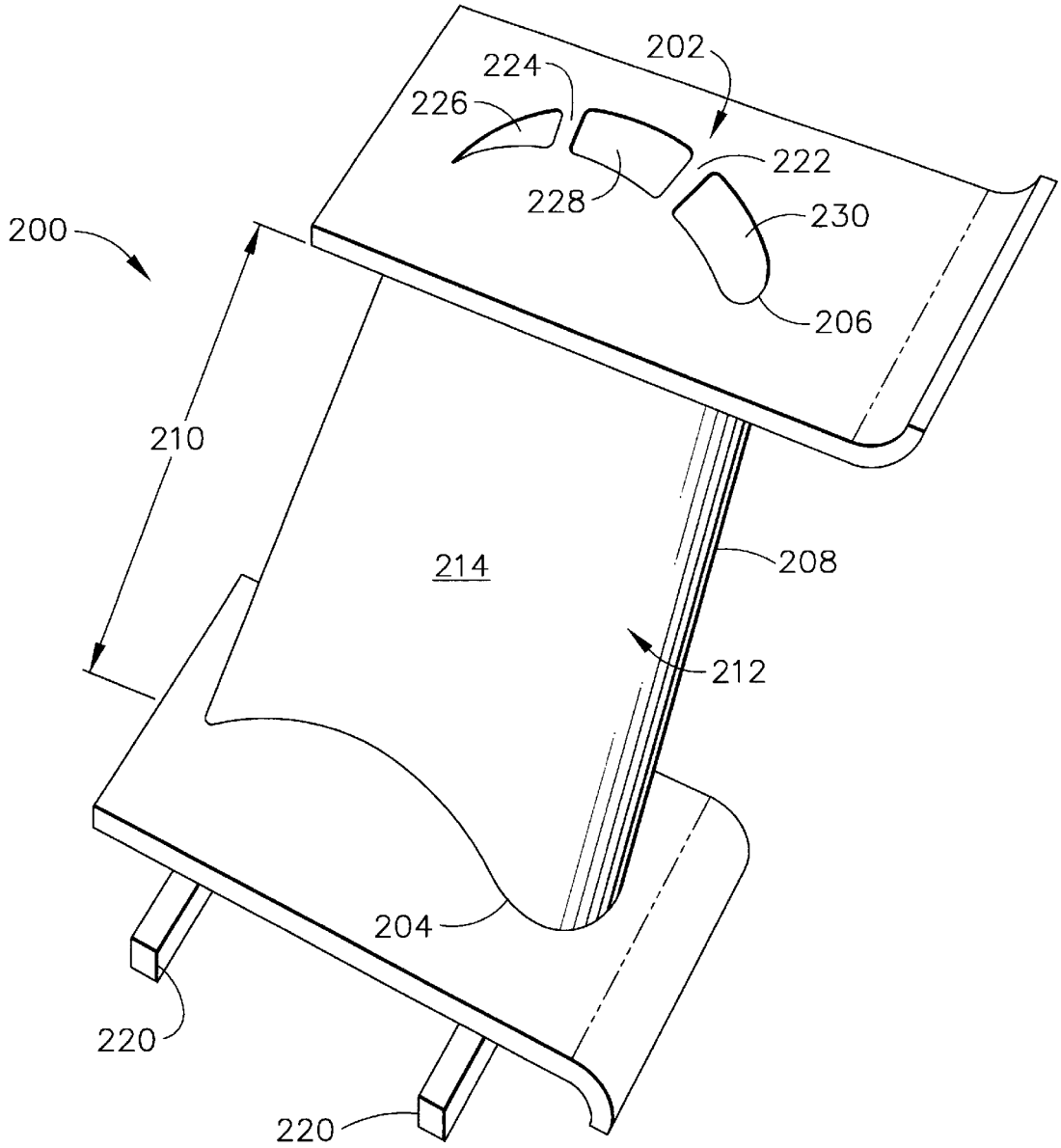
FIG. 4 is a perspective view of a high pressure vane including a parted spar arrangement.

FIG. 4 is a perspective view of a high pressure vane 200 including a parted spar arrangement 202. Vane 200 includes a vane root 204, a vane tip 206, and a vane span 208 extending between vane root 204 and vane tip 206. Vane span 208 has a length 210 and includes a skin covering 212 which extends over vane span 208 from vane root 204 to vane tip 206. Skin covering 212 includes an outer skin surface 214 and an inner skin surface (not shown). High pressure vane 200 extends from a mounting feature 220 which is configured to anchor vane 200.

Parted spar arrangement 202 includes a first spar 222 and a second spar 224. First spar 222 is positioned between a first cavity 230 and a second cavity 228. Second spar 224 is positioned between cavity 228 and a third cavity 226.

Figure 5:
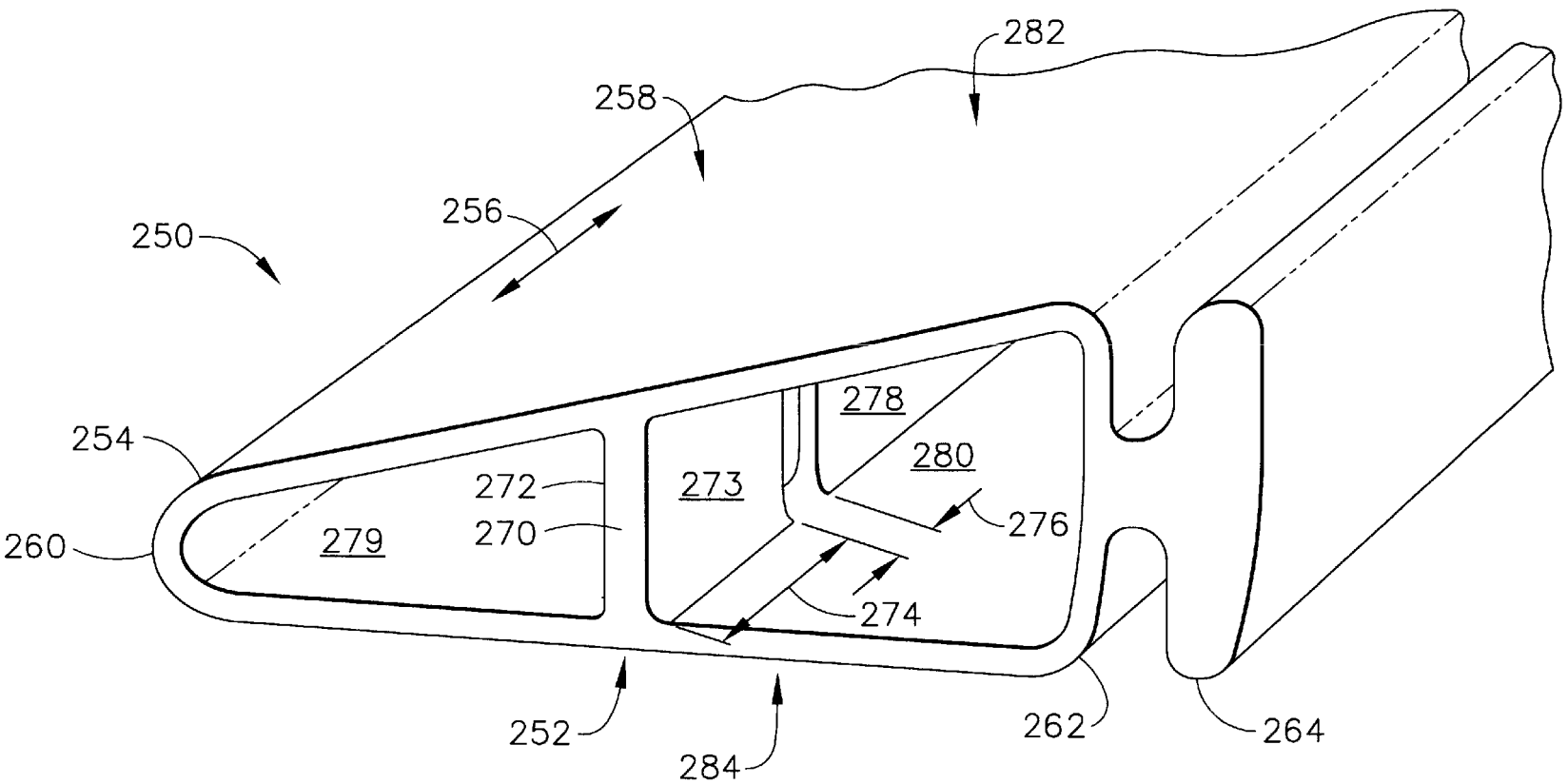
FIG. 5 is a perspective view of a strut leading edge extension including a parted spar arrangement.

FIG. 5 is a perspective view of a strut leading edge extension 250 including a parted spar arrangement 252. Strut leading edge extension 250 has a first end 254, a second end (not shown), and an extension span 256 extending between first end 254 and the second end. A skin covering 258 extends over extension 250 from first end 254 to the second end and defines a leading edge 260 and a trailing edge 262. Trailing edge 262 extends to a mounting feature 264 configured to anchor strut leading edge extension 250 to a strut (not shown). In one embodiment, mounting feature 264 is a dovetail key.

Parted spar arrangement 252 includes a first spar portion 270. First spar portion 270 has a first side 272, a second side 273 and a length 274. First spar portion 270 is parted along span 256 of strut leading edge extension by a parting distance 276 and has a second portion 278. First side 272 bounds a first cavity 279 and second side 273 bounds a second cavity 280. First spar 270 is formed integrally with skin covering 258 and extends from a first side 282 of strut leading edge extension 250 to a second side 284 of strut leading edge extension 250. Thus, a total spar length of parted spar arrangement 252 is equal to a sum of the length of second portion 278 and length 274 of first portion 270, and this total spar length is less than span 256.

The above-described turbine airfoil includes parted spar arrangements that are cost-effective and reliable. The turbine airfoil includes at least one spar arrangement which has an overall length less than that of a turbine airfoil blade length and which includes a plurality of spars to support the airfoil skin from the internal pressures generated by the cooling system. Furthermore, the spar arrangement permits the outer skin surfaces of the turbine airfoil to thermally expand. Such expansion prevents thermal strains within the turbine airfoil and permits the spar arrangement to be constructed from a low strength and low ductility material. Accordingly, a cost effective and accurate airfoil spar arrangement is provided.

While the invention has been described in terms of various specific embodiments, those skilled in the art will recognize that the invention can be practiced with modification within the spirit and scope of the claims.

What is claimed is:

1. A turbine airfoil comprising:

a blade root;

a blade tip;

a first side;

a second side laterally opposite said first side;

a blade span extending between said blade root and said blade tip; and at least one spar arrangement having a length less than a length of said blade span and positioned between said blade root and said blade tip, said spar arrangement comprising a plurality of spars, a first said spar having a width extending from said turbine airfoil first side to said turbine airfoil second side, at least one of said plurality of spars comprising at least one of a composite material and a ceramic material.

2. A turbine airfoil in accordance with claim 1 wherein said spar arrangement is configured to reduce thermal stress of the turbine airfoil.

3. A turbine airfoil in accordance with claim 2 further comprising a skin covering extending over said blade span, said turbine airfoil first side connected to said second side and defining a leading edge extending to a trailing edge, said leading edge positioned axially opposite said trailing edge.

4. A turbine airfoil in accordance with claim 3 wherein said first spar comprises a first side and a second side, said first side bounds a first cavity, said first spar second side bounds a second cavity.

5. A turbine airfoil in accordance with claim 4 wherein said plurality of spars further comprises a second spar comprising a first side and a second side.

6. A turbine airfoil in accordance with claim 5 wherein said second spar first side bounds said second cavity and said second spar second side bounds a third cavity.

7. A turbine airfoil in accordance with claim 4 wherein said spar arrangement comprises a low strength and low ductility material.

8. A turbine airfoil in accordance with claim 4 wherein said spar arrangement comprises a ceramic matrix composite material.

9. A turbine airfoil in accordance with claim 4 wherein said spar arrangement comprises a monolithic ceramic material.

10. A turbine airfoil in accordance with claim 5 wherein said first spar has a first width and wherein said second spar has a second width extending from said turbine airfoil first side to said turbine airfoil second side.

11. A turbine airfoil in accordance with claim 10 wherein said first spar first width and said second spar second width are configured such that said turbine airfoil second side has a greater curvature than said first side.

12. A turbine airfoil in accordance with claim 10 wherein said first spar first width and said second spar second width are configured such that said turbine airfoil second side has a curvature that is identical to a curvature of said turbine airfoil first side.

13. A spar arrangement for a turbine airfoil having a first side and a second side and including a blade root, a blade tip, and a blade span extending between the blade tip and the blade root, said spar arrangement configured to reduce thermal stress within the turbine airfoil, said spar arrangement comprising:

a plurality of spars comprising at least a first spar, said plurality of spars having a length less than a length of the blade span, said first spar extending between the turbine airfoil first side and second side, at least one of said plurality of spars comprising at least one of a composite material and a ceramic material.

14. A spar arrangement in accordance with claim 13 further comprising a skin covering extending over the turbine airfoil, said spar arrangement extending from said skin covering.

15. A spar arrangement in accordance with claim 14 wherein said first spar comprises a first side and a second side, said first side bounds a first cavity, said second side bounds a second cavity.

16. A spar arrangement in accordance with claim 15 wherein said plurality of spars further comprises a second spar having a first side and a second side, said second spar first side bounds said second cavity, said second spar second side bounds a third cavity.

17. A spar arrangement in accordance with claim 15 wherein said spar arrangement comprises a low strength ductility material.

18. A spar arrangement in accordance with claim 15 wherein said spar arrangement comprises a ceramic matrix composite material.

19. A spar arrangement in accordance with claim 15 wherein said spar arrangement comprises a monolithic ceramic material.

* * * * *